United States Patent [19]

Marthaler

[11] 4,014,698

[45] Mar. 29, 1977

[54] METHOD FOR PROCESSING SILVER DYE BLEACH MATERIALS

[75] Inventor: Max Marthaler, Marly, Switzerland

[73] Assignee: Ciba-Geigy AG, Basel, Switzerland

[22] Filed: June 30, 1975

[21] Appl. No.: 591,803

[30] Foreign Application Priority Data

July 10, 1974 Switzerland ..... 9506/74

[52] U.S. Cl. ..... 96/53; 96/20; 96/60 R

[51] Int. Cl.[2] ..... G03C 7/00

[58] Field of Search ..... 96/53, 20, 60 R

[56] References Cited

UNITED STATES PATENTS

| | | | |
|---|---|---|---|
| 3,620,744 | 11/1971 | Schellenberg et al. | 96/20 |
| 3,868,253 | 2/1975 | Marthaler et al. | 96/53 |

*Primary Examiner*—J. Travis Brown

*Attorney, Agent, or Firm*—Joseph G. Kolodny; Edward McC. Roberts; Prabodh I. Almaula

[57] ABSTRACT

The present invention relates to a new method for processing silver dye bleach material. The process measures of this method, consisting of (1) silver developing, (2) dye bleaching, (3) silver bleaching, (4) silver fixing are carried out in the sequence (1) to (4) with appropriate preparations. The silver bleaching (3) preparation contains (a) a strong acid, (b) a water-soluble iodide, (c) a water-soluble oxidizing agent, (d) a diazine compound and (e) an anti-oxidant. An excellent and rapid bleaching is achieved.

8 Claims, No Drawings

METHOD FOR PROCESSING SILVER DYE BLEACH MATERIALS

The conventional processing of silver dye bleach materials comprises essentially the following process steps:

1. Silver developing (developing the latent silver image)
2. Silver image fixing (removing the unexposed silver halide)
3. Dye bleaching (bleaching the image dyestuffs as a function of the amount of silver developed image-wise)
4. Silver bleaching (oxidative bleaching of residual silver)
5. Final fixing (removing residual light-sensitive silver compounds which have not been removed from the material during dye bleaching and silver bleaching).

It is also known that one can dispense with the second stage, for example, as described in DT-OS No. 2,309,526, by using the bath sequence (1) silver developing bath, (2) dye bleach bath, (3) bleach-fixing bath and (4) silver fixing bath, in which case the silver developing bath can already contain dye bleach catalyst. On the other hand, washing steps are introduced, as required, between the individual stages, and additional treatments in stop baths, hardening baths, stabilising baths and final baths can be included.

Conventional processing methods for silver dye bleach material are described, for example, in DT-OS Nos. 1,472,811 and 1,924,723 and in textbooks, for example E. Mutter "Farbphotographie, Theorie und Praxis" ("Colour Photography, Theory and Practice"), page 57 [Springer 1967]. Finally, German Pat. No. 735,672 describes a process in which as many as three reaction stages, namely the two bleach baths and the fixing bath, are combined together in a single process step.

In special cases, which in detail depend on the make-up of the material and on the desired effects, for example where the dye equilibrium has to meet particular requirements, however, the conventional process with separate treatment stages continues to maintain its importance, alongside the shortened processes. In addition to the known problems, new difficulties which relate specifically to the silver bleaching stage have arisen in connection with the increased importance of effluent problems.

In silver bleaching, as in combined bleach-fixing processes, strong oxidising agents have to be used. In silver dye bleach processes, as also in other processes in colour photography, the salts and complex compounds of those heavy metals which occur in several valency levels have particularly proved valuable. Above all, compounds of the trivalent iron (British Pat. Specification No. 802,275) or of divalent copper [Swiss Pat. Nos. 507,536 or 508,899] are used. A widely used silver bleaching agent is, in particular, potassium ferricyanide which has been known since as early as 1883, for example in the form of Farmer's reducer. For combined bleachfixing baths, other complex compounds of trivalent iron, such as, say, the chelate with ethylenediaminetetraacetic acid, are preferably used, the latter compound particularly in chromogenic processes.

Spent ferricyanide bleach baths can, under current legislation, only be discharged as effluent after sufficient detoxication, that is to say removal of the iron ions and cyanide ions. For commercial reasons, in addition to the ecological aspects mentioned, the recovery of silver has also gained in importance. Whilst various usable methods for desilvering of fixing baths are known, additional problems arise in desilvering bleach-fixing baths. In the customary desilvering with iron filings or steel wool, additional amounts of iron go into solution and must subsequently again be removed from the effluent in the form of excess spent bleach-fixing solution. This is true both of ferricyanide baths and of baths which contain other complexes of trivalent iron. A further disadvantage of baths containing ferricyanide is that occasionally precipitates of Prussian blue are formed, which can undesirably contaminate the processing tanks and the material processed therein.

Various attempts have therefore already been made to avoid the use of heavy metal compounds in silver bleach baths by various measures. Thus, for example, it has been proposed in German Pat. No. 947,221 to use, as oxidising agents in bleach-fixing baths, organic nitro compounds such as, say, 2,4-dinitrobenzenesulphonic acid, together with a silver ligand which gives water-soluble silver complexes, such as thiourea or sodium thiosulphate. If, however, attempts are made to use such nitro compounds in a non-fixing bleach bath without silver ligand, only a very slow and incomplete bleaching action is achieved.

It has now been found that silver bleach baths which, in the presence of iodide ions, contain, in addition to an organic nitro compound as the oxidising agent, also one of the diazine compounds usually known as dye bleach catalysts, for example derivatives of pyrazine or quinoxaline, display an excellent and rapid bleaching action even in the absence of silver ligands which form soluble complexes and in the absence of oxidising heavy metal compounds.

Admittedly, it has already been disclosed by German Pat. No. 735,672 to use a mixture of quinoxaline compounds with organic nitro compounds, which additionally contains silver ligands such as thiourea or ammonium thiocyanate, as a combined dye bleach bath and silver bleach bath and at the same time as a fixing bath in an essentially two-stage processing method for silver dye bleach material. However, in such a process the use of diazine compounds is suggested by the fact that the dye bleach process takes place simultaneously, and furthermore the bath again contains a fixing silver ligand, like the bleach-fixing solution proposed in German Pat. No. 947,221.

In contrast it has now been found that a bath used after completion of dye bleaching, and containing, in addition to a water-soluble iodide, an organic nitro compound and a diazine compound of the type mentioned, effects very rapid silver bleaching, whilst the dye bleaching action is negligibly slow in comparison to that of the preceding actual dye bleach bath and stops completely in a short time as a result of the rapid removal of the metallic silver.

The invention accordingly relates to a method for processing silver dye bleach materials, entailing the process measures of (1) silver developing, (2) dye bleaching, (3) silver bleaching and (4) silver fixing, and the process is characterised in that, whilst using preparations appropriate for treatment stages (1) to (4) and using them in the sequence (1) to (4), a preparation (3) is used for silver bleaching which contains (a) a strong acid, (b) a water-soluble iodide, (c) a water-soluble organic oxidising agent, preferably a water-soluble organic nitro compound, (d) a diazine compound, preferably in an amount of 0.2 to 5 g/liter and (e) an antioxidant.

In general, the preparations required for the processing are allowed to act on the material in the form of their dilute aqueous solutions. However, other methods, for example use in paste form, are also conceivable. The temperature of the baths during processing, and in particular also the temperature of the silver bleach bath (3), can in general be between 20° and 60° C, and of course the requisite processing time is shorter at a higher temperature than at a lower temperature.

By strong acids (a) there are to be understood, in the present context, those which impart a pH value of at most 2 to the silver bleach bath (3), especially sulphuric acid or sulphamic acid. However, other strong acids, such as phosphoric acid, can also be used.

The water-soluble iodide (b) used is, for example, potassium iodide or sodium iodide. The amount of iodide is suitably 2 to 50 g per liter of preparation.

Amongst the nitro compounds (c) which can be used as water-soluble organic oxidising agents it is advantageous to use, in amounts of 1 to 30 g per liter, water-soluble aromatic nitro compounds, preferably aromatic mononitrobenzene-sulphonic acids or dinitrobenzene-sulphonic acids, for example those of the formula

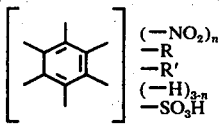

wherein $n$ is 1 or 2 and R and R′ denote hydrogen, lower alkyl, alkoxy, amino or halogen. The sulphonic acids can be added as readily soluble salts. For example, the sodium salts or potassium salts of the following acids are suitable: 3-nitrobenzenesulphonic acid, 2,4-dinitrobenzenesulphonic acid, 3,5-dinitrobenzenesulphonic acid, 3-nitro-4-chlorobenzenesulphonic acid, 2-chloro-5-nitrobenzenesulphonic acid, 4-methyl-3,5-dinitrobenzenesulphonic acid, 3-chloro-2,5-dinitrobenzenesulphonic acid, 2-amino-4-nitrobenzenesulphonic acid and 2-amino-4-nitro-5-methoxybenzenesulphonic acid.

Instead of the sulphonic acids, it is also possible to use carboxylic acids such as, say, 3-nitrobenzoic acid, 3-nitrophthalic acid or 4-nitrophthalic acid. Further oxidising agents which can be used are polynuclear aromatic sulphonic acids such as 2-amino-5-nitronaphthalene-4,8-disulphonic acid or 8-nitroanthraquinone-2-sulphonic acid. Anthraquinone compounds in many cases have a sufficient oxidising action even without nitro groups present as substituents and can be used in the silver bleach preparation. Thus, usable results are obtained, for example, also with anthraquinone-2-sulphonic acid or anthraquinone-2,5-disulphonic acid.

Examples of suitable diazine compounds are pyrazine or its derivatives substituted by methyl, ethyl and/or carboxylic acid groups, such as 2-methylpyrazine, 2-ethylpyrazine, 2,3-, 2,5- or 2,6-dimethylpyrazine, pyrazinecarboxylic acid, pyrazine-2,3-, -2,5- or -2,6-dicarboxylic acid or 2,3-dimethylpyrazine-5,6-dicarboxylic acid. Water-soluble quinoxalines having the following substituents are particularly suitable: a) a hydroxyl group in both the 2- and the 3-position and the following substituents on the benzene ring: 6-methoxy or 6,7-dimethoxy or [6,7-b]-dioxolo or dioxano, or b) an acylated hydroxymethyl group in both the 2- and 3-position and a methoxy group in both the 6- and 7-position on the benzene ring, or c) a methyl group in both the 2- and 3-position and either no substituent, or the following substituents, on the benzene ring: methyl or alkoxy or amino or 6-hydroxy or 5,8-dihydroxy or a sulphonic acid group.

As antioxidants it is possible to use organic mercapto compounds, advantageously in amounts of 0.5 to 10 g per liter of preparation. Compounds of the type of the reductones, such as are described, for example, in Swiss Pat. No. 508,899, are also particularly suitable, in particular acireductones having a 3-carbonyl(1,2)-enediol grouping, such as reductin, triose reductone or, preferably, ascorbic acid.

The silver bleach preparation according to the invention can also be prepared in the form of a liquid concentrate and can, because of its good stability, be stored for a prolonged period. It is advantageous to use, for example, two liquid concentrates, of which one contains the strong acid and the organic nitro compound and the other contains the remaining components, it being possible to add, to the latter concentrate, an additional solvent such as ethyl alcohol or propyl alcohol, methyl cellosolve or ethyl cellosolve, to improve the solubility, especially of the diazine compound.

The ratios of the individual consitutents of the bleach bath can be varied within rather wide limits.

For silver developing (bath 1) it is possible to use baths of customary composition, for example those which contain hydroquinone and, if desired, additionally also 1-phenyl3-pyrazolidone, as the developer substance. Furthermore it is advantageous if the silver developing bath additionally contains a dye bleach catalyst, as described in Swiss Pat. No. 405,929.

As dye bleach baths it is advantageous to use those which in addition to a strong acid, a water-soluble iodide and an antioxidant for the iodide, contain a dye bleach catalyst. Suitable dye bleach catalysts are described, for example, in DT-AS Nos. 2,010,280, 2,144,298 and 2,144,297, in French Pat. No. 1,489,460, in U.S. Pat. No. 2,270,118 and in DT-OS No. 2,448,433.

The silver fixing bath can be of known and customary composition. Examples of suitable fixers are sodium thiosulphate or, advantageously, ammonium thiosulphate, if desired with additives such as sodium bisulphite.

EXAMPLE 1

A photographic material with three colour layers for the silver dye bleach process is prepared on a pigmented cellulose acetate carrier; it contains, in the lowest, red-sensitive, layer, the cyan image dyestuff of the formula

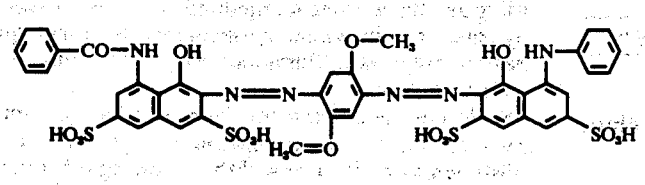

(2)

in the green-sensitive layer, above the preceding layer, the magenta image dyestuff of the formula

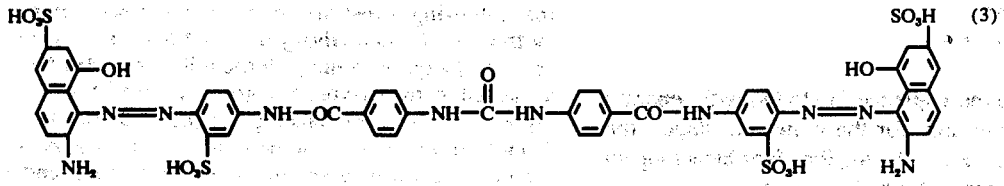

(3)

and in the uppermost, blue-sensitive, layer, the yellow image dyestuff of the formula

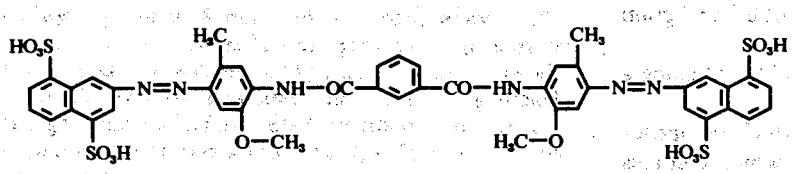

The image dyestuffs are incorporated into the emulsions so as to give a reflectance density of D = 2.0. The colour layers, containing a total of 2.0 g Ag/m², are separated by gelatine layers, the total layer thickness being 22 μ.

The material is exposed to blue, green and red light behind a step wedge and is processed in accordance with the following instructions. The temperature of all the baths is 24° C.

| | |
|---|---|
| 1. Silver developing: 6 minutes | |
| Na polyphosphate | 1 g/litre |
| Anhydrous Na sulphite | 50 g/litre |
| Hydroquinone | 5 g/litre |
| Na metaborate | 15 g/litre |
| 1-Phenyl-3-pyrazolidone | 0.3 g/litre |
| Potassium bromide | 3 g/litre |
| Benztriazole | 0.2 g/litre |
| 2. Washing: 5 minutes | |
| 3. Dye-bleaching: 7 minutes | |
| Water | 800 ml |
| 96% strength sulphuric acid | 14 ml |
| Ascorbic acid | 1 g |
| Potassium iodide | 30 g |
| Catalyst: 2,3-dimethyl-5-amino-6-methoxy-quinoxaline | 0.08 g |
| Water, ad | 1,000 ml |
| 4. Washing: 3 minutes | |
| 5. Silver bleaching: 3 minutes | |
| Water | 800 ml |
| 96% strength sulphuric acid | 20 ml |
| Na 2,4-dinitrobenzenesulphonate | 10 g |
| Ascorbic acid | 1 g |
| Potassium iodide | 6 g |
| Ammonium chloride | 20 g |
| 2,3,6-Trimethylquinoxaline | 0.5 g |
| Water, ad | 1,000 ml |
| 6. Washing: 3 minutes | |
| 7. Fixing: 7 minutes | |
| Ammonium thiosulphate | 200 g/litre |
| Anhydrous Na sulphite | 20 g/litre |
| 8. Washing: 8 minutes | |

In this way, a positive dyestuff image of the step wedge is obtained, a good neutral white being obtained behind the lightest wedge step. This means that the developed image silver has been completely oxidised in the silver bleach bath and has been completely dissolved out of the material, together with the undeveloped silver halide, in the fixing bath.

COMPARISON EXPERIMENT A

The procedure followed is as in Example 1, but the 2,3,6-trimethylquinoxaline is omitted from the silver bleach bath. After processing, a positive dyestuff image of the step wedge is recognisable, but a negative silver image remains superposed thereon. The silver formed as a negative image of the step wedge in the silver developer has thus been oxidised only inadequately in the silver bleach bath. Even on extending the silver bleach time from 3 to 12 minutes, a residual silver fog remains behind the lightest wedge step and a grey-tinted white is obtained

COMPARISON EXPERIMENT B

Comparison experiment A is repeated, again without 2,3,6-trimethylquinoxaline in the silver bleach bath, but with the content of potassium iodide increased from 6 to 60 g/liter. This markedly accelerates the silver bleaching but here again, even after 12 minutes' treatment time, a residual silver fog is obtained, which manifests itself as a less good white in the lightest wedge step.

Examples 2 to 6

The procedure followed is as in Example 1, but instead of sulphuric acid, sulphamic acid in a concentration of 80 g/liter is used in the silver bleach bath, and the following compounds are used as bleach accelerators:

| | | |
|---|---|---|
| Example 2: | 2,3-dimethylquinoxaline | 0.7 g/litre |
| Example 3: | 2,5-dimethylpyrazine | 1.2 ml/litre |
| Example 4: | 2,3-dihydroxymethyl-6,7-dimethoxy-quinoxaline | 1.0 g/litre |
| Example 5: | 2,3-dimethyl-6-ethoxyquinoxaline | 1.3 g/litre |

-continued

| | | |
|---|---|---|
| Example 6: | 2,3-dimethyl-6-aminoquinoxaline | 0.3 g/litre |

The processing results obtained are similar to those in Example 1.

I claim:

1. In the method for processing silver dye bleach material wherein the process measures of 1. silver developing,
2. dye bleaching,
3. silver bleaching and
4. silver fixing are carried out in the sequence (1) to (4) with separate appropriate preparations for the individual stages, the step which comprises employing for silver bleaching an aqueous preparation (3) which contains a. a strong acid,
b. a water-soluble iodide,
c. a water-soluble organic nitro compound,
d. a diazine compound in an amount of 0.2 to 5 gram per liter of preparation (3) and
e. an anti-oxidant, only preparation (3) containing a nitro compound.

2. Process according to claim 1, which comprises using a silver bleach preparation (3) which contains sulphuric acid or sulphamic acid.

3. Process according to claim 1, which comprises using as the water-soluble nitro compound (c) an aromatic dinitro compound.

4. Process according to claim 3, which comprises using as the water-soluble nitro compound a dinitro benzene sulphonic acid.

5. Process according to claim 1, which comprises using as the diazine compound (d) a water-soluble pyrazine or quinoxaline compound with an absorption maximum below 450 nm and using as the anti-oxidant (e) a reductone.

6. Process according to claim 5, which comprises using as the diazine compound a) pyrazine without substituents or with 1 to 4 of the following substituents: methyl, ethyl or carboxyl, with at most two of any one of these substituents being present simultaneously, or b) a quinoxaline with the following substituents: a hydroxymethyl group in both the 2- and 3-position and the following substituents on the benzene ring: 6-methoxy or 6,7-dimethoxy or [6,7-b]-dioxolo or -dioxano, or c) a quinoxaline with the following substituents: an acylated hydroxymethyl group in both the 2- and 3-position and a methoxy group in both the 6- and 7-position on the benzene ring, or d) a quinoxaline with a methyl group in both the 2- and 3-position and no substituent, or the following substituents, on the benzene ring: methyl, alkoxy, amino, 6-hydroxy, 5,8-dihydroxy or a sulphonic acid group, ascorbic acid being used as the anti-oxidant.

7. Process according to claim 1, which comprises interposing a washing step after at least one of the following process steps: (1) silver developing, (2) dye bleaching, (3) silver bleaching and (4) silver fixing.

8. Aqueous treatment bath suitable for carrying out the silver bleaching step (3) of the process according to claim 1, which treatment bath contains (a) a strong acid which produces a pH value of at most 2, (b) a water-soluble iodide in an amount of 2 to 50 g/liter, (c) a water-soluble organic nitro compound in an amount of 1 to 30 g/liter, (d) a diazine compound in an amount of 0.2 to 5 g/liter and (e) an anti-oxidant in an amount of 0.5 to 10 g/liter.

* * * * *